United States Patent [19]

Hiro et al.

[11] Patent Number: 4,818,654

[45] Date of Patent: Apr. 4, 1989

[54] ELECTROPHOTOGRAPHIC PHOTOSENSITIVE MEMBER WITH COMBINATION OF POLYMETHYL METHACRYLATE RESINS

[75] Inventors: Masaaki Hiro, Kanagawa; Toshiyuki Yoshihara, Mitaka, both of Japan

[73] Assignee: Canon Kabushiki Kaisha, Tokyo, Japan

[21] Appl. No.: 4,276

[22] Filed: Jan. 13, 1987

Related U.S. Application Data

[63] Continuation of Ser. No. 698,831, Feb. 6, 1985, abandoned.

[30] Foreign Application Priority Data

Feb. 10, 1984 [JP] Japan ..... 59-23999

[51] Int. Cl.[4] ..... G03G 5/14; G03G 5/04

[52] U.S. Cl. ..... 430/59; 430/58; 430/96

[58] Field of Search ..... 430/58, 59, , 96

[56] References Cited

U.S. PATENT DOCUMENTS 3,121,006 2/1906 Middleton et al. ..... 430/84 X 3,850,630 11/1974 Regensburger et al. ..... 430/58

FOREIGN PATENT DOCUMENTS 1337228 11/1973 United Kingdom ..... 430/58

*Primary Examiner*—Roland E. Martin

*Attorney, Agent, or Firm*—Fitzpatrick, Cella, Harper & Scinto

[57] ABSTRACT

An electrophotographic photosensitive member is provided which has an electroconductive substrate and a photosensitive layer, said photosensitive layer containing at least one of (I) polymethyl methacrylates having a molecular weight of $28\times10^4$ or lower, preferably $1.0\times10^4$ to $28\times10^4$ and at least one of (II) polymethyl methacrylates having a molecular weight of $50\times10^4$to $250\times10^4$, preferably $100\times10^4$ to $250\times10^4$, said polymethyl methacrylate (II) being contained at a proportion of 0.1 part by weight to 30 parts by weight in the composition consisting of the polymethyl methacrylates (I) and (II).

15 Claims, No Drawings

ELECTROPHOTOGRAPHIC PHOTOSENSITIVE MEMBER WITH COMBINATION OF POLYMETHYL METHACRYLATE RESINS

This application is a continuation of application Ser. No. 698,831 filed Feb. 6, 1985, now abandoned.

BACKGROUND OF THE INVENTION

1. Field of the Invention

This invention relates to an electrophotographic photosensitive member comprising an organic photoconductor, more particularly to a lamination type electrophotographic photosensitive member provided by coating with a photosensitive layer with a laminated structure having a charge generating layer and a charge transporting layer.

2. Description of the Prior Art

The surface of the photosensitive layer of an electrophotographic photosensitive member is subjected directly to electrical, thermal and further mechanical external force in various processes in an electrophotographic copying machine, such as corona charging, toner developing, transfer onto paper, cleaning treatment, etc., and therefore the photosensitive layer is required to have durability against lowering in sensitivity or lowering in potential attributable to deterioration by ozone generated during corona charging, increase in residual potential or generation of friction or damage on the surface by scraping. Particularly, in a lamination type electrophotographic photosensitive member having a charge transporting layer provided by coating on a charge generating layer, the charge transporting layer is deteriorated by ozone generated during corona charging. For this reason, when image formation is carried out in repeated cycles, lowering in sensitivity will gradually be brought about. Alternatively, if a resin with high hardness is employed for the charge transporting layer for enhancement of resistance against external mechanical force, the coating characteristic may be unsatisfactory, or no sufficient sensitivity can be obtained. Thus, a very difficult problem is involved in choice of a resin from among a large number of resins in consideration of both electrophotographic characteristic and coating characteristic.

As the binder resin used heretofore in the charge transporting layer, polycarbonate, polymethyl methacrylate, polyallylate, polystyrene and polyester have been proposed. However, electrophotographic photosensitive members by use of these resins have many points to be improved such as insufficient mechanical strength, or the problem in manufacturing step caused by poor coating characteristic.

SUMMARY OF THE INVENTION

An object of the present invention is to provide an electrophotographic photosensitive member which has solved such problems as described above.

Another object of the present invention is to provide an electrophotographic photosensitive member in which drop of sensitivity during an electrophotographic process in repeated cycles is reduced.

Still another object of the present invention is to provide an electrophotographic photosensitive member having high durability.

The present inventors have made extensive studies following such objects and consequently found that excellent electrophotographic characteristcs can be obtained by use of a blended composition of a low molecular weight polymethyl methacrylate and a high molecular weight polymethyl methacrylate for the photosensitive layer, particularly as the binder resin in the charge transporting layer.

More specifically, the present invention provides an electrophotographic photosensitive member having a photosensitive layer on an electroconductive substrate, said photosensitive layer containing at least one of (I) polymethyl methacrylates having a molecular weight of $28\times10^4$ or lower, preferably $1.0\times10^4$ to $28\times10^4$ and at least one of (II) polymethyl methacrylates having a molecular weight of $50\times10^4$ to $250\times10^4$, preferably $100\times10^4$ to $250\times10^4$, said polymethyl methacrylate (II) being contained at a proportion of from 5 to 15 parts by weight in the composition consisting of 100 parts by weight of the polymethyl methacrylates (I) and (II).

DESCRIPTION OF THE PREFERRED EMBODIMENTS

In preferred embodiments of the present invention, the above-mentioned blended composition containing polymethyl methacrylates (I) and (II) can be used as the binder resin in the charge transporting layer in the photosensitive layer having a laminated structure of a charge generating layer and a charge transporting layer.

For obtaining a lamination type electrophotographic photosensitive member excellent in durability, a material with little lowering in electrophotographic characteristics such as lowering in sensitivity, lowering in potential and increase in residual potential due to deterioration by ozone generated during corona charging, should be used, as a matter of course. Moreover, it is also indispensable to effect hardening of the charge transporting layer in order to give resistance against external mechanical force such as contact with paper, cleaning treatment, etc. and therefore high hardness is required for a resin to be used as the binder resin in the charge transporting layer.

The most general way of enhancing hardness of a resin is to increase its molecular weight. Hardness of a resin generally becomes higher with the increase in its molecular weight, but beyond a certain level, further increase in the molecular weight does not result in increased hardness but in a constant value. This constant value is inherent in individual resin and, among thermoplastic resins for general purpose, polymethyl methacrylate exhibits a large value. From this fact, it is an effective means to employ a high molecular weight of polymethyl methacrylate excellent in electrophotographic characteristics as a means for obtaining a lamination type of durable electrophotographic photosensitive member.

On the other hand, the film thickness of the charge transporting layer contributes to acceptance potential and sensitivity and is generally formed within the range of from about 10 to 20 $\mu$. As the method for forming the charge transporting layer, there may be employed the methods by coating such as by spraying, roll coater, bar coater, knife coater, blade coater, dipping, etc. In obtaining charge transporting layers of desired thickness according to these coating methods, the solution viscosity is an important factor to the productivity. For example, in the dip coating method which gives a smooth surface without seam of a cylindrical substrate (including the steps of dipping a cylindrical substrate into a coating substrate), the solution with a too high viscosity will yield too thick film even with an extremely reduced coating speed. On the other hand, when such a solution is applied with a lowered viscosity by dilution, the coating speed is required to be increased extremely because of a lowered solid content. Under such conditions, variation in film thickness of the coating in vertical direction (i,e. the variation in film thickness of the coating in the length direction of the cylindrical substrate) becomes greater, with the result that the potential irregularity is also increased corresponding to the film thickness irregularity to be unsuitable for practical application. The solution viscosity depends on the molecular weight of the resin used as the binder, and therefore use of a single component high molecular weight polymer, which leads to extremely high solution viscosity, as the binder resin in the charge transporting layer involves a problem in production and therefore is not practical.

The present inventors have made extensive studies to solve the above problem and consequently discovered the blended composition of the polymethyl methacrylates (I) and (II) as specified above. Particularly, according to a preferred embodiment, a photosensitive layer, particularly a charge transporting layer containing 0.1 part by weight to 30 parts by weight of the polymethyl methacrylate (II) in the above blended composition is suitable. If the polymethyl methacrylate (II) is contained in an amount more than 30 parts by weight, the surface potential after charging will be elevated excessively to be unpractical. On the other hand, when the polymethyl methacrylate (II) is less than 0.1 part by weight, there is involved the drawback such as lowering in sensitivity due to deterioration by ozone generated during corona charging.

The polymethyl methacrylate to be used in the present invention can be synthesized easily according to a conventional polymerization process, for example, the radical polymerization method such as solution polymerization, suspension polymerization and bulk polymerization, or the ion polymerization method. The polymethyl methacrylate (I) with a lower molecular weight should preferably be polymerized by solution polymerization or suspension polymerization, while the polymethyl methacrylate (II) with a higher molecular weight by suspension polymerization or bulk polymerization. The polymerization initiator may be any compound, so long as it can initiate polymerization, but preferably a peroxide such as cumene hydroperoxide or benzoyl peroxide, an azo compound such as azobisisobutyronitrile or azobiscyclohexanecarbonitrile or a redox system initiator such as cobalt naphthenate and sulfinic acid. The solvent to be used in solution polymerization may be any solvent which can dissolve well the monomer and the polymer formed, particularly preferably aromatic hydrocarbons such as toluene or xylene, halo-substituted aromatic hydrocarbons such as monochlorobenzene, esters such as ethyl acetate or butyl acetate, and carbonyl compounds such as acetone or methyl ethyl ketone.

Resins other than the blended composition of the polymethyl methacrylates (I) and (II) as described above may also be incorporated in the charge transporting layer in an amount which will not damage the electrophotographic characteristics and the coating characteristic.

In the case of preparing a charge transporting layer with the use of the blended composition of the polymethyl methacrylates (I) and (II) as described above, there may be used as the charge transporting material the compounds below pyrene; N-ethylcarbazole, N-isopropylcarbazole, hydrazones such as N-methyl-N-phenylhydrazino-3-methylidene-9-ethylcarbazole, N, N-diphenylhydrazino-3-methylidene-9-ethylcarbazole, N, N-diphenylhydrazino-3-methylidene-10-ethylphenothiazine, N, N-diphenylhydrazino-3-methylidene-10-ethylphenoxazine, p-diethylaminobenzaldehyde-N, N-diphenylhydrazone, p-diethylaminobenzaldehyde-N-α-naphthyl-N-phenylhydrazone, p-pyrrolidinobenzaldehyde-N, N-diphenylhydrazone, 1, 3, 3-trimethylindolenine-ω-aldehyde-N, N-diphenylhydrazone, p-diethylbenzaldehyde-3-methylbenzothiazolinone-2-hydrazone, etc.; 2,5-bis(p-diethylaminophenyl)-1, 3, 4-oxadiazole; pyrazolines such as 1-phenyl-31, (p-diethylaminostyryl)-5-(p-diethylaminophenyl)pyrazoline, 1-[quinolyl(2)]-3-(p-diethyl-aminostyryl-5-(p-diethylaminophenyl)pyrazoline, 1-pyridyl(2)]-3-(p-diethylaminostyryl)-5-(p-diethylaminophenyl)pyrazoline, -[6-methoxy-pyridyl(2)]-3-(p-diethylaminostyryl)-5-(p-diethylaminophenyl)pyrazoline, 1-pyridyl(3)]-3-(p-diethylaminostyryl)-5-(p-diethylaminophenyl)pyrazoline, 1-[lepidyl(2)]-3-(p-diethyl-aminostyryl)-5-(p-diethylaminophenyl)pyrazoline, 1-[pyridyl(2)]-3-(p-diethylaminostyryl)-4-methyl-5-(p-diethylaminophenyl)-pyrazoline, 1-[pyridyl(2)]-3-(e-methyl-p-diethylaminostyryl)-5-(p-diethylaminophenyl)pyrazoline, 1-phenyl-3-(p-diethylaminostyryl)-4-methyl-5-(p-diethylaminophenyl)pyrazoline, 1-phenyl-3-(o-benzyl-p-diethylaminostyryl)-5-(p-diethylaminophenyl)pyrazolihe, spiropyrazoline, etc.; oxazole compounds such as 2-(p-diethyl-aminostyryl)-6-diethylaminobenzoxazole, 2-(p-diethylamino-phenyl)-4-(p-dimethylaminophenyl)-5-(2-chlorophenyl)-oxazole, etc.; thiazole compounds such as 2-(p-diethylaminostyryl)-6-diethylaminobenzothiazole, etc.; triarylmethane compounds such as bis(4-diethylamino-2-methyl-phenyl) phenylmethane, etc.; polyarylalkanes such a 1, 1-bis(4-N, N-diethylamino-2-methylphenyl)-heptane, 1,1,2,2-tetrakis(4-N, N-dimethylamino-2-methylphenyl) ethane, etc. Particularly, it has been found that more excellent electrophotographic characteristics can be obtained by use of a hydrazone compound or a pyrazoline compound.

Although the reason has not yet been clarified, as one of the factors, good compatibility of the binder resin of the present invention with a hydrazone compound and a pyrazoline compound may be mentioned. When compatibility the binder resin with the compound is little, precipitation of the compound may occur with lapse of time or change in environment, whereby the copied image may be markedly impaired.

When preparaing the electrophotographic photosensitive member, the substrate to be employed may be a cylinder or a film made of a metal such as aluminum, stainless steel or alloy, paper or plastic. On these substrates, there may be also provided an subbing layer (adhesive layer) functioning as a barrier and an undercoat.

The subbing layer is formed for the purpose of improvement of adhesion of the charge transporting layer, improvement of coating characteristic, protection of the substrate, coating of the defect on the substrate, improvement of charge injection from the substrate, protection of the photosensitive layer against electrical destruction, etc. As the material for the subbing layer known in the art, there may be included polyvinyl alcohol, poly-N-vinylimidazole, polyethylene oxide, ethyl cellulose, methyl cellulose, ethylene-acrylic acid copolymer, casein, polyamide, copolymer nylon, hide glue, gelatin, etc. These may be applied on the substrate as solutions dissolved in appropriate solvents. Its film thickness may be about 0.2 to 2 μ.

The charge generating layer is formed by dispersing a charge generating pigment together with 0.5 to 4-fold amount of a binder resin and a solvent by means of homogenizer, sonication, ball mill, vibrating ball mill, sand mill, attritor, roll mill, etc., followed by coating and drying. Its thickness may be about 0.1 to 1 μ.

The charge transporting layer is formed by applying a solution of a charge transporting material and the blended composition of the polymethyl methacrylates (I) and (II) as described above dissolved in a solvent on the charge generating layer. The mixing ratio of the charge transporting material to the polymethyl methacrylate blend composition may be about 2 1 to 1:2. As the solvent, there may be employed ketones such as acetone, methyl ethyl ketone and the like, esters such as methyl acetate, ethyl acetate and the like, aromatic hydrocarbons such as toluene, xylene and the like, chlorinated hydrocarbons such as chlorobenzene, chloroform, carbon tetrachloride and the like.

The electrophotographic photosensitive member of the present invention can be utilized not only for electrophotographic copying machines but also widely for various fields of electrophotographic application such as lase printer, CRT printer, electrophotographic photoengraving system, etc.

The present invention is described in more detail by referring to the following Examples.

In the Examples, the weight-average molecular weights of the polymethyl methacrylates and the viscosities of the coating solutions for charge transporting layer were measured under the following conditions.

(a) Molecular weight (Mw)

Measurement by gel permeation chromatography (GPC).

Apparatus: "High Performance Liquid Chromatograph 244" produced by Waters Co.

Column: one column of "GMH" produced by Toyo Soda Manufacturing Co.

Standard substance: Standard Polystyrene produced by Toyo Soda Manufacturing Co.; max. molecular weight: $448\times10^4$ Measuring conditions:

Sample preparation:
polymethyl methacrylate
10 mg/tetrahydrofuran
4 ml

Amount of injection: 200 μl

Solvent: tetrahydrofuran

Flow rate: 1 ml/min.

Temperature: 23°±1° C.

Detector: Differential refractometer.

(b) Viscosity

Apparatus: "Single cylindrical rotary viscometer, Model VS-Al", produced by Seiki Kogyo Kenkyusho Measuring conditions:

Amount of sample: 100 ml/100 ml cup No. 2 rotor, 60 rpm, measured value after one minute:

Temperature: 23°±1° C.

EXAMPLE 1

An aluminum cylinder of 80 Φ×300 mm was employed as the substrate. This substrate was coated with a methanol solution of a polyamide resin (trade name: Amylan CM-8000, produced by Toray) according to the dipping method to provide a subbing layer with a thickness of 1μ thereon.

Then, 10 parts ("parts" to appear herein after is based on "weight") of a disazo pigment of the formula:

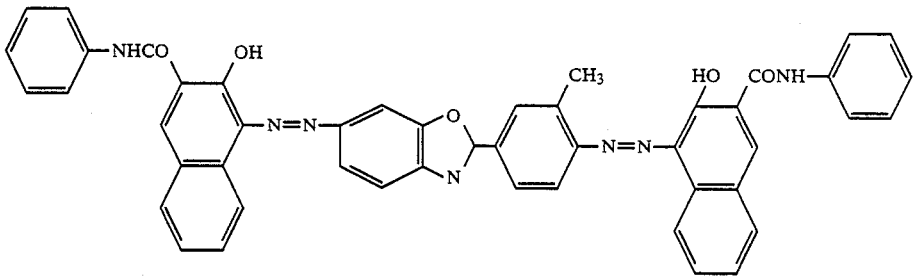

8 parts of a polyvinyl butyral resin (trade name: Ethleck BXL, produced by Sekisui Kagaku K.K.) and parts of cyclohexanone were dispersed in a sand mill device with the use of 1 ϕ glass beads for 20 hours. To the resulting dispersion were added 70 to 120 parts (arbitrarily) of methyl ethyl ketone, and the mixture was applied on the subbing layer to form a charge generating layer with a thickness of 0.15μ.

Subsequently, 75 parts of a hydrazone compound of the formula:

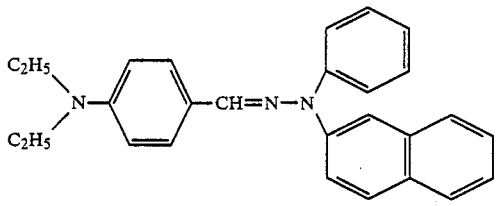

8.5 parts of a polymethyl methacrylate having a weight-molecular weight of $9.5\times10^4$ and 1.5 parts of a polymethyl methacrylate having a weight-average molecular weight of $195\times10^4$ were dissolved in 65 parts of monochlorobenzene. The solution was applied on the charge generating layer according to the dipping method and dried on hot air at 100 ° C. for one hour to form a charge transporting layer with a thickness of 16μ. The solution had a viscosity of 205 cP, with a coating speed (withdrawing speed) being 110 mm/min., and the film thickness variation in the vertical direction in the charge transporting layer was 1.5μ.

The electrophotographic photosensitive member thus prepared was evaluated for its characteristics by mounting on an electrophotographic copying machine having the steps of −5.6 KV corona charging, image exposure, dry system toner developing, toner transfer onto plain paper and cleaning by a urethane rubber blade (hardness 70°, pressure 5 gw/cm, angle relative to photosensitive member 20°). The sensitivity was evaluated by measuring the exposure necessary for decaying the potential to 1/10 of the value at the 5-second dark decay following the aforesaid −5.6KV corona charging ($E_{1/10}$ lux.sec). As the result, a high sensitivity characteristic of 10.6 lux.sec was exhibited and very clear images were obtained. After repetition of copying tests for 10,000 times, the sensitivity was 11.9 lux.sec, indicating small lowering in sensitivity, and images were also found to be good. The decrease in film thickness after repetitive copying was as small as 1.5μ.

COMPARATIVE EXAMPLE 1

Seven parts of the hydrazone compound as shown in Example 1 and 10 parts of a polymethyl methacrylate having a molecular weight of $9.5\times10^4$ were dissolved in 45 parts of monochlorobenzene. The solution has a viscosity of 95 cP. The aluminum cylinder, having the subbing layer and the charge generating layer formed thereon in the same manner as in Example 1, was coated with this solution according to the dip coating method at a coating speed (withdrawing speed) of 210 mm/min. As the result, although a charge transporting layer with a film thickness of 14μ was formed, the film thickness variation in the vertical direction was 4μ. The photosensitive member obtained after hot air drying at 100 ° C. for one hour was evaluated for electrophotographic characteristics in the same manner as in Example 1, but the image irregularity caused by the irregularity of the charge transporting layer in the vertical direction was conspicuously observed, and the decrease in film thickness after successive copying tests repeated for 10,000 times was as large as 5.5μ.

COMPARATIVE EXAMPLE 2

Seven parts of the hydrazone compound as shown in Example 1, 5.0 parts of a polymethyl methacrylate having a molecular weight of $9.5\times10^4$ and 5.0 parts of a polymethyl methacrylate having a molecular weight of $195\times10^4$ were dissolved in 70 parts of monochlorobenzene. The solution had a viscosity of 500 cP or more, and the aluminum cylinder having formed the subbing layer and the charge generating layer in the same manner as in Example 1 was subjected to dip coating. As the result, even at a coating speed (withdrawing speed) of 40 mm/min., the charge transporting layer formed had a film thickness of 20μ or more, and the electrophotographic characteristics evaluated in the same manner as in Example 1 gave no practical value, such as extremely large surface potential after corona charging.

EXAMPLE 2

Seven parts of the hydrazone compound as shown in Example 1, 9.5 parts of a polymethyl methacrylate having a molecular weight of $28\times10^4$ and 0.5 part of a polymethyl methacrylate having a molecular weight of $195\times10^4$ were dissolved in 65 parts of monochlorobenzene. The solution had a viscosity of 185 cP. The aluminum cylinder having the subbing layer and the charge generating layer formed thereon in the same manner as in Example 1 was coated with this solution according to the dip coating method at a coating speed (withdrawing speed) of 125 mm/min. As the result, a charge transporting layer with a film thickness of 15μ was formed. After hot air drying at 100 ° C. for one hour, a photosensitive member was obtained. The film thickness variation in vertical direction of the charge transporting layer was found to be 2μ.

When the photosensitive member was evaluated in the same manner as in Example 1, its sensitivity was found to be 11.0 lux.sec, which was changed to 12.3 lux.sec after successive copying repeated for 10,000 times. The images after repeated copying for 10,000 times were also good, with the film thickness decrease being 2.0μ.

COMPARATIVE EXAMPLE 3

Seven parts of the hydrazone compound as shown in Example 1 and 10 parts of a polymethyl methacrylate having a molecular weight of $195\times10^4$ were dissolved in 100 parts of monochlorobenzene. The solution had a viscosity of 500 cP or more and the aluminum cylinder having the subbing layer and the charge generating layer formed thereon in the same manner as described in Example 1 was coated by dipping with this solution. The charge transporting layer formed even at a coating speed (withdrawing speed) of 40 mm/min. had a film thickness of 20μ or more, and the electrophotographic characteristics evaluated in the same manner as in Example 1 were not practical, as shown typically by the extremely large surface potential after corona charging.

We claim:

1. An electrophotographic photosensitive member having a photosensitive layer on an electroconductive substrate, said photosensitive layer containing at least one (I) low molecular weight polymethyl methacrylate having a molecular weight of $28\times10^4$ or lower, and at least one (II) high molecular weight polymethyl methacrylate having a molecular weight of $50\times10^4$ to $250\times10^4$, said polymethyl methacrylate (II) being contained in a proportion of from 5 to 15 parts by weight in the composition consisting of 100 parts by weight of the polymethyl methacrylates (I) and (II), wherein said photosensitive layer has a laminated structure comprising a charge generating layer and a charge transporting layer, said charge transporting layer containing said composition of polymethyl methacrylates (I) and (II).

2. An electrophotographic photosensitive member according to claim 1, wherein said polymethyl methacrylate (I) has a molecular weight of $1.0\times10^4$ to $28\times10^4$.

3. An electrophotographic photosensitive member according to claim 1, wherein said polymethyl methacrylate (I) is formed according to a solution polymerization method or a suspension polymerization method.

4. An electrophotographic photosensitive member according to claim 1, wherein said polymethyl methacrylate (II) has a molecular weight of $100\times10^4$ to $250\times10^4$.

5. An electrophotographic photosensitive member according to claim 1, wherein said polymethyl methacrylate (II) is formed according to a suspension polymerization method or a bulk polymerization method.

6. An electrophotographic photosensitive member according to claim 1, wherein said charge transporting layer is provided by coating onto the charge generating layer.

7. An electrophotographic photosensitive member according to claim 1, wherein said charge transporting layer contains at least one charge transporting compound selected from the group of consisting of polycyclic aromatics, carbazoles, hydrazone, pyrazolines, oxazole compounds, thiazole compounds, triarylmethance compounds and polyarylalkanes.

8. An electrophotographic photosensitive member according to claim 7, wherein said compound is a hydrazone.

9. An electrophotographic photosensitive member according to claim 7, wherein said compound is a pyrazoline.

10. An electrophotographic photosensitive member according to claim 1, having a subbing layer between said electroconductive substrate and the photosensitive layer.

11. An eletrophotographic photosensitive member prepared by the process of forming a charge transporting layer on a charge generating layer, said process comprising the step of dipping an electroconductive substrate on which a charge generating layer has previously been formed into a coating solution for formation of a charge transporting layer obtained by dissolving a charge transporting material and a blended composition containing at least one (I) low molecular weight polymethyl methacrylate havig a molecular weight of $28\times10^4$ or lower and at least one (II) high molecular weight polymethyl methacrylate having a molecular weight of $50\times10^4$ to $250\times10^4$, said polymethyl methacrylate (II) being contained in a proportion of from 5 to 15 parts by weight in the composition consisting of 100 parts by weight of the polymethyl methacrylates (I) and (II), in an organic solvent, and the step of withdrawing said electroconductive substrate from said coating solution wherein said photosensitive member has a structure comprising a charge generating layer and a charge transporting layer.

12. An electrophotographic photosensitive member according to claim 11, wherein a subbing layer is previously formed on said electroconductive substrate.

13. An electrophotographic photosensitive member according to claim 11, wherein said electroconductive substrate is a cylindrical substrate of a metal or an alloy.

14. An electrophotographic photosensitive member according to claim 11, wherein said polymethyl methacrylate (I) has a molecular weight of $1.0\times10^4$ to $5.0\times10^4$.

15. An electrophotographic photosensitive member according to claim 11, wherein said polymethyl methacrylate (II) has a molecular weight of $100\times10^4$ to $250\times10^4$.

* * * * *

UNITED STATES PATENT AND TRADEMARK OFFICE

CERTIFICATE OF CORRECTION

PATENT NO. : 4,818,654

DATED : April 4, 1989

INVENTOR(S) : MASAAKI HIRO, ET AL.

It is certified that error appears in the above-identified patent and that said Letters Patent is hereby corrected as shown below:

ON THE TITLE PAGE:

IN [56] REFERENCES CITED

U.S. PATENT DOCUMENTS, "3,121,006 2/1906 Middleton et al." should read --3,121,006 2/1964 Middleton et al.--.

IN [57] ABSTRACT

Line 7, "50 X $10^4$to" should read --50 X $10^4$ to--.

COLUMN 1

Line 14, "membcr" should read --member--.

UNITED STATES PATENT AND TRADEMARK OFFICE

CERTIFICATE OF CORRECTION

PATENT NO. : 4,818,654

DATED : April 4, 1989

INVENTOR(S) : MASAAKI HIRO, ET AL.

It is certified that error appears in the above-identified patent and that said Letters Patent is hereby corrected as shown below:

COLUMN 4

Line 1, "below" should read --below:--.
Line 14, "1-phenyl-31," should read --1-phenyl-3- --.
Line 16, "(p-diethyl-aminostyryl-5-" should read --(p-diethyl-aminostyryl)-5- --.
Line 19, "-[6-methoxy-pyridyl(2)]" should read --1-[6-methoxy-pyridyl(2)]--.
Line 25, "(e-methyl-" should read --(α-methyl- --.
Line 28, "(o-benzyl-" should read --(α-benzyl- --.
Line 29, "pyrazolihe," should read --pyrazoline,--.
Line 47, "patibility the" should read --patibility of the--.
Line 51, "preparaing" should read --preparing--.
Line 55, "an" should read --a--.

COLUMN 5

Line 16, "2 1 to 1:2." should read --2:1 to 1:2.--.
Line 40, "lase printer," should read --laser printer,--.

COLUMN 6

Line 18, "herein after" should read --hereinafter--.
Line 34, "and parts" should read --and 50 parts--.
Line 54, "weight-" should read --weight-average--.

UNITED STATES PATENT AND TRADEMARK OFFICE

CERTIFICATE OF CORRECTION

PATENT NO. : 4,818,654

DATED : April 4, 1989

INVENTOR(S) : MASAAKI HIRO, ET AL.

It is certified that error appears in the above-identified patent and that said Letters Patent is hereby corrected as shown below:

COLUMN 9

Line 1, "triarylmethance" should read --triarylmethane--.
Line 13, "eletrophotographic" should read --electrophotographic--.
Line 22, "havig" should read --having--.

COLUMN 10

Line 7, "tion" should read --tion,--.
Line 19, "5.0 X $10^4$." should read --28 X $10^4$.--.

Signed and Sealed this

Sixteenth Day of January, 1990

*Attest:*

JEFFREY M. SAMUELS

*Attesting Officer* *Acting Commissioner of Patents and Trademarks*